US006942043B2

(12) United States Patent
Kurkoski

(10) Patent No.: US 6,942,043 B2
(45) Date of Patent: Sep. 13, 2005

(54) MODULAR DESIGN FOR LWD/MWD COLLARS

(75) Inventor: Philip Lawrence Kurkoski, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 86 days.

(21) Appl. No.: 10/463,028

(22) Filed: Jun. 16, 2003

(65) Prior Publication Data

US 2004/0251048 A1 Dec. 16, 2004

(51) Int. Cl.[7] ..... E21B 47/12
(52) U.S. Cl. ..... 175/40; 175/45; 367/33
(58) Field of Search ..... 175/24, 26, 27, 175/40, 45, 61, 73; 367/33, 34, 35; 33/772, 773

(56) References Cited

U.S. PATENT DOCUMENTS 4,547,833 A 10/1985 Sharp ..... 361/386
5,216,242 A 6/1993 Perry et al. ..... 250/269
5,251,708 A * 10/1993 Perry et al. ..... 175/41
5,439,064 A * 8/1995 Patton ..... 175/24
5,613,561 A 3/1997 Moriarty ..... 166/387
5,679,894 A * 10/1997 Kruger et al. ..... 73/152.03
5,924,499 A * 7/1999 Birchak et al. ..... 175/40
6,158,529 A * 12/2000 Dorel ..... 175/61
6,173,793 B1 1/2001 Thompson et al. ..... 175/45
6,206,108 B1 * 3/2001 MacDonald et al. ..... 175/24
6,466,513 B1 * 10/2002 Pabon et al. ..... 367/35

* cited by examiner

*Primary Examiner*—Frank Tsay
(74) *Attorney, Agent, or Firm*—Madan, Mossman & Sriram, P.C.

(57) ABSTRACT

A modular system for packaging of sensors and related electronics for an MWD system. A drill collar housing is provided with one or more cavities for receiving sensor modules that are adapted to sense one or more wellbore conditions. The sensor modules are removable and replaceable so that a desired sensor package may be installed within the drill collar housing. The drill collar housing is installed within the drill string, and a desired sensor module or modules are secured within the cavity(ies) of the drill collar housing. Replacement or repair of the sensor portions requires only that the module or modules be removed from the cavity(ies). The drill collar housing need not be removed from the drill string. The replaceable sensor modules may be interchangeably used in drill collar housings of different sizes without resulting in a degradation of sensed information.

21 Claims, 5 Drawing Sheets

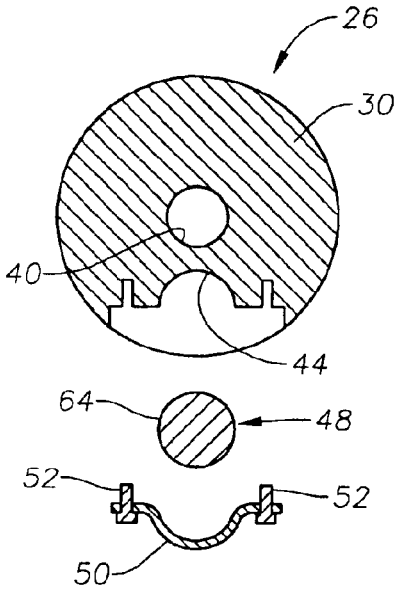
Fig. 4
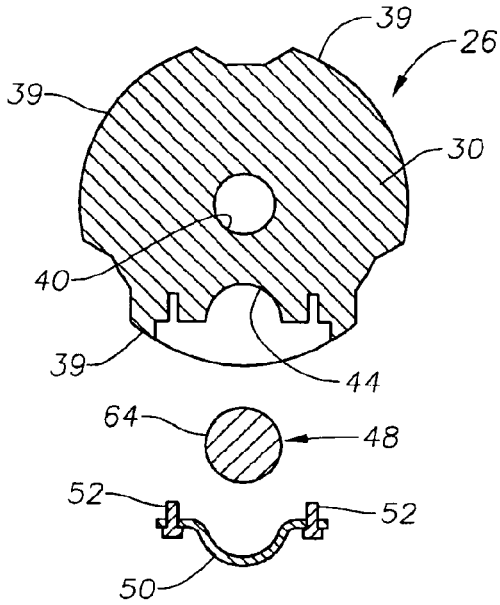
Fig. 4A
Fig. 5
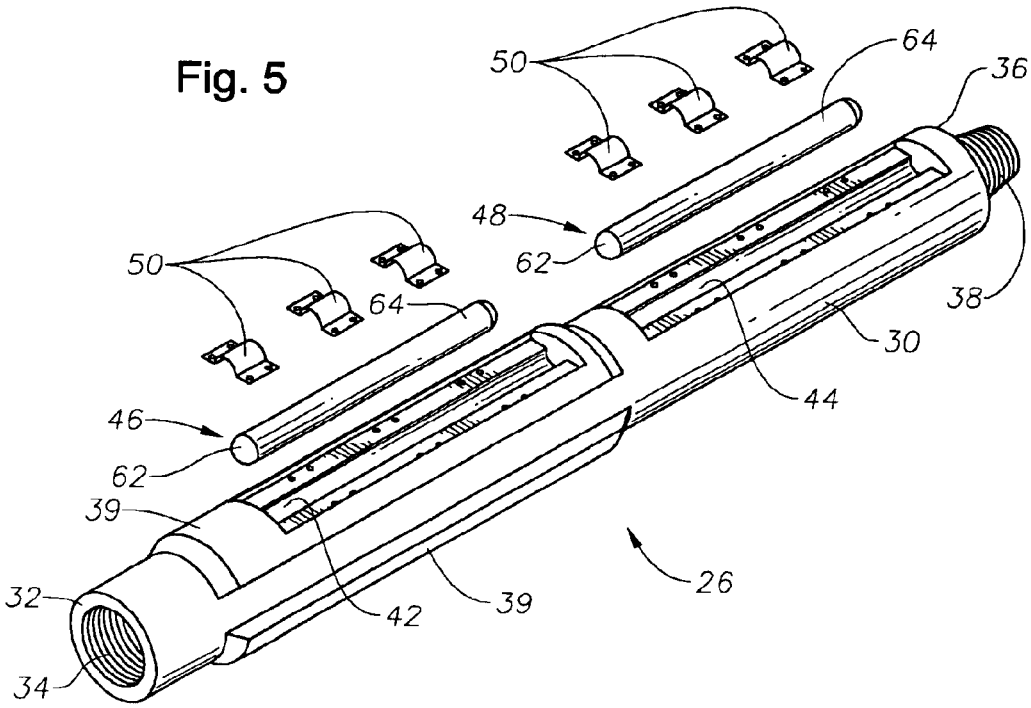

MODULAR DESIGN FOR LWD/MWD COLLARS

BACKGROUND OF THE INVENTION

1. Field of the Invention

The invention relates generally to measurement-while-drilling and logging-while-drilling tools and, more particularly, to arrangements for packaging of the sensor and detector portions of the tools.

2. Description of the Related Art

Measurement-while-drilling (MWD) and logging-while-drilling (LWD) devices are used to determine wellbore parameters and operating conditions during drilling of a well. These parameters and conditions may include formation density, gamma resistivity, acoustic porosity, and so forth. In a typical drilling run, only some of these parameters and conditions may be of interest, however. MWD and LWD tools generally include a sensor portion that contains the sensors of the type desired and a processor and associated storage medium for retaining the sensed information. Additionally, a telemetry system is often used to transmit the sensed information uphole. The telemetry system may include a mud pulser, acoustic telemetry option, or an electromagnetic transmission system.

The sensor portion of MWD or LWD systems is typically housed within a drill collar in a such a manner that the sensor portion cannot be easily removed and replaced. In fact, removal and replacement of the sensor portion typically requires that the drill string be removed from the wellbore, and then the portions above and below the drill collar housing the sensor portion be disassembled from the drill collar. This operation is time-consuming and, therefore, costly. Additionally, the drill collars involved are quite heavy and unwieldy and the process of changing out a sensor section runs the risk of damaging the components. Further, if some of the sensor components malfunction, the entire drill collar must often be removed and shipped off site for repair or replacement. Shipping tools back to a repair center is costly and time consuming.

There are several conventional methods for packaging sensor components within a drill collar. In one method, exemplified in U.S. Pat. No. 5,216,242, issued to Perry et al., sensors and detectors are hardwired within the drill collar sub and accessable via removable hatches. Another packaging arrangement is illustrated in U.S. Pat. No. 4,547,833, issued to Sharp. In this arrangement, the sensors and detectors are mounted upon a chassis, which is then retained centrally within an outer cylindrical housing. These components are then secured together with a number of fasteners and integrated into a drill string. Of course, to change out or repair the sensors and detectors, one must first remove the adjacent drill string components, as well as the various fasteners, and then remove the outer housing from the chassis. U.S. Pat. No. 5,613,561 issued to Moriarty illustrates a similar packaging scheme wherein components mounted on the chassis are accessible through ports.

MWD and LWD tools have high capital costs and operating costs. Indeed, the high costs associated with LWD tools have made them unattractive for use with land-based wells. Conventional packaging arrangements make it difficult and expensive to design for the three basic hole sizes (8½", 9½", and 12¼"). Traditional MWD/LWD tool design has required unique tool for each hole size. Each tool requires many man-years to design and develop. Also, field inventory must be kept on hand for every size, multiplying costs further. To overcome these difficulties, manufacturers often "orphan" one hole size, and adapt a tool from one of the other two hole sizes for the orphaned hole size. For example, a tool designed to be run into an 8½" hole would be provided with an adapter and run into a 9½" hole. Unfortunately, the quality of the log of data obtained in this manner is less than satisfactory. LWD tools, in particular, are designed for a particular hole size. The components are integral to the collar. When they are used in a hole size that they were not designed for, the measurement is either lost or seriously degraded. Some tools use a sleeve to improve the measurement by displacing mud away from the measurement sensors. This, however, has limited success because the sensors remain in their original location, yet are now even further displaced from the formation that they are trying to measure the properties of.

The present invention addresses the problems of the prior art.

SUMMARY OF THE INVENTION

The invention provides a modular system for packaging of sensors and related electronics for an MWD system. The system features a drill collar housing with one or more cavities for receiving sensor modules that are adapted to sense one or more wellbore conditions. The sensor modules are removable and replaceable so that a desired sensor package may be installed within the drill collar housing. The drill collar housing is installed within the drill string, and a desired sensor module or modules are secured within the cavity(ies) of the drill collar housing. Replacement or repair of the sensor portions requires only that the module or modules be removed from the cavity(ies).

The drill collar housing need not be removed from the drill string. In some embodiments, the drill collar housing contains power and data transmission means so that power can be supplied to the modules and data transmitted from the modules. In other embodiments, the modules are self-contained and do not require power or data to be supplied to or transmitted from them. In these embodiments, the modules include an internal battery for power and data storage means for storing sensed data. Data is recovered from the modules after the drilling operation is completed and the drilling string removed from the wellbore. Alternatively, the drill collar housing might include or be associated with a mud turbine and pulser for transmission of sensed data to the surface using fluid pulsing techniques that are known in the art.

The modular system of the present invention overcomes the problems of the prior art. The replaceable sensor modules may be interchangeably used in drill collar housings of different sizes without resulting in a degradation of sensed information. Further, there is no need to remove the drill collar housing from the drill string in order to repair portions of the sensor arrangement. In addition, the significant costs of transporting entire MWD tool to a remote repair facility or replacing the entire tool. In addition, the costs of maintaining inventory for various hole sizes will be significantly reduced. The concept of modularity permits a low cost alternative by separating the tool hardware from the drill collar. The collar can remain at the wellsite as part of the drilling bottom hole assembly and can be disposed into the wellbore without the modules as a standard component. When a logging job is required, the modules can be secured within the collar and used with surface-based monitoring equipment. In particular aspects, the drill collar may merely be a "dumb" collar having no electronics or power supplies therein and merely serving as a housing for the sensor modules.

Drill collar carriers of any size can accept a standard set of modules. In this manner, the drill collar can be optimized for the drilling operation in terms of size and strength. The modules, on the other hand, can be optimized for the measurement of formation and as noted, will fit into any of the drill collar carriers. Since each drill collar carrier is designed for a particular hole size, along with the complete bottom hole assembly, the module will always be in close proximity to the formation and provide a good measurement. An integral stabilizer blade that extends radially outwardly from the drill collar carrier can position a module close to the formation for improved performance. Drill collar carriers can either have radially outwardly extending stabilizer blades for housing the modules or, alternatively, can be integral (slick) to present a generally cylindrical outer surface.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein:

FIGS. 4 and 4A are axial cross-sections of the drill collar assembly taken along lines 4—4 and 4A—4A in FIG. 2, respectively.

FIG. 5 is an isometric, exploded view of an exemplary drill collar assembly constructed in accordance with the present invention.

DETAILED DESCRIPTION OF THE PREFERRED EMBODIMENTS

Figure 1:
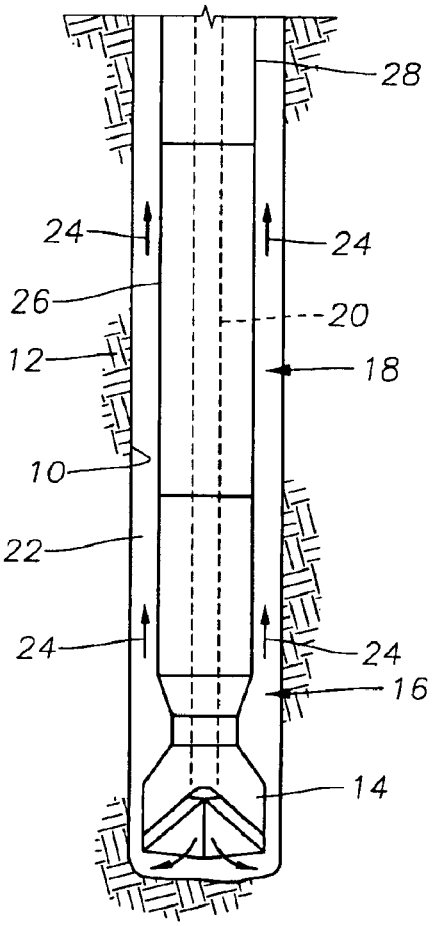
FIG. 1 is a schematic side view of an exemplary drill string and bottom hole assembly containing a MWD/LWD drill collar assembly constructed in accordance with the present invention.
Figure 2:
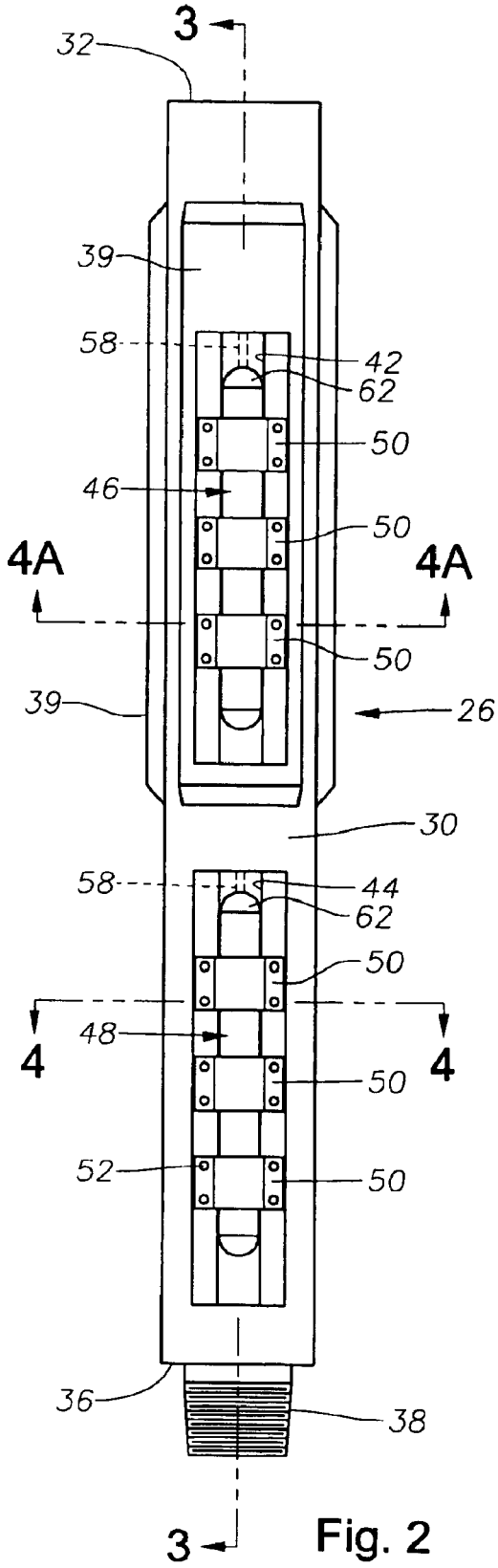
FIG. 2 is a side view of the exemplary MWD/LWD drill collar assembly shown in FIG. 1.

FIG. 1 illustrates the lower end of an exemplary wellbore 10 that is being drilled into the earth 12 by a drill bit 14 and bottom hole assembly 16 that are suspended by a drill string, indicated generally at 18. The drill string 18, as is known, is made up of a plurality of subs and drill pipe sections that are threaded together to form a single tubular string. The drill string 18 defines a central drilling mud conduit 20 therein. During a drilling operation, drilling mud is flowed from the surface of the wellbore 10 downward through the mud conduit 20 and out through the bit 14 in order to lubricate the drilling operation. The drilling mud then returns to the surface of the well via the annulus 22 (as indicated by arrows 24) that is defined between the inner surfaces of the wellbore 10 and the outer surfaces of the drill string 18.

A drill collar assembly 26 is schematically illustrated in FIG. 1 and shown integrated within the drill string 18 just above the BHA 16. The drill collar 26 is an exemplary sensor sub constructed in accordance with the present invention and which features an improved packaging arrangement for the sensor and detector components of an MWD system Above the drill collar 26 is a tubular sub (the lower end of which is shown at 28 in FIG. 1) that carries additional MWD or LWD system components, including a processor and storage medium. As such components are known in the art and, thus, will not be described further herein. The sub 28 also includes a turbine (not shown), of a type known in the art that is powered by flow of drilling mud through the mud channel 20. The turbine is used to provide electrical power to the drill collar assembly 26 for actuation of sensor components therewithin. Suitable turbines for this application are available commercially from Baker Hughes, Inteq Division at 2001 Rankin Rd., Houston, Tex. 77267. It is noted as well that the present invention is not limited to use of a turbine and that other power sources known in the art could as easily be used to supply power to components within the drill collar assembly 26. Such power sources include, but are not limited to batteries and cables that extend from the surface of the wellbore 10. The sub 28 may also include a telemetry device, such as a pulser that is capable of transmitting data via a fluid column using encoded pulses.

An exemplary drill collar assembly 26 is shown in greater detail in FIGS. 2, 3, 4, and 5. The drill collar assembly 26 includes a generally cylindrical drill collar housing, or body, 30 with a first, upper end 32 having a box-type threaded connection 34 and a second, lower end 36 having a pin-type threaded connection 38. The upper end of the drill collar housing 30 presents three radially outwardly extending stabilizer blades 39. The drill collar housing 30 defines a central mud flow channel 40 along its length. When the drill collar assembly 26 is integrated into a drill string, the mud flow channel 40 aligns with and become a portion of the mud conduit 20.

Figure 7:
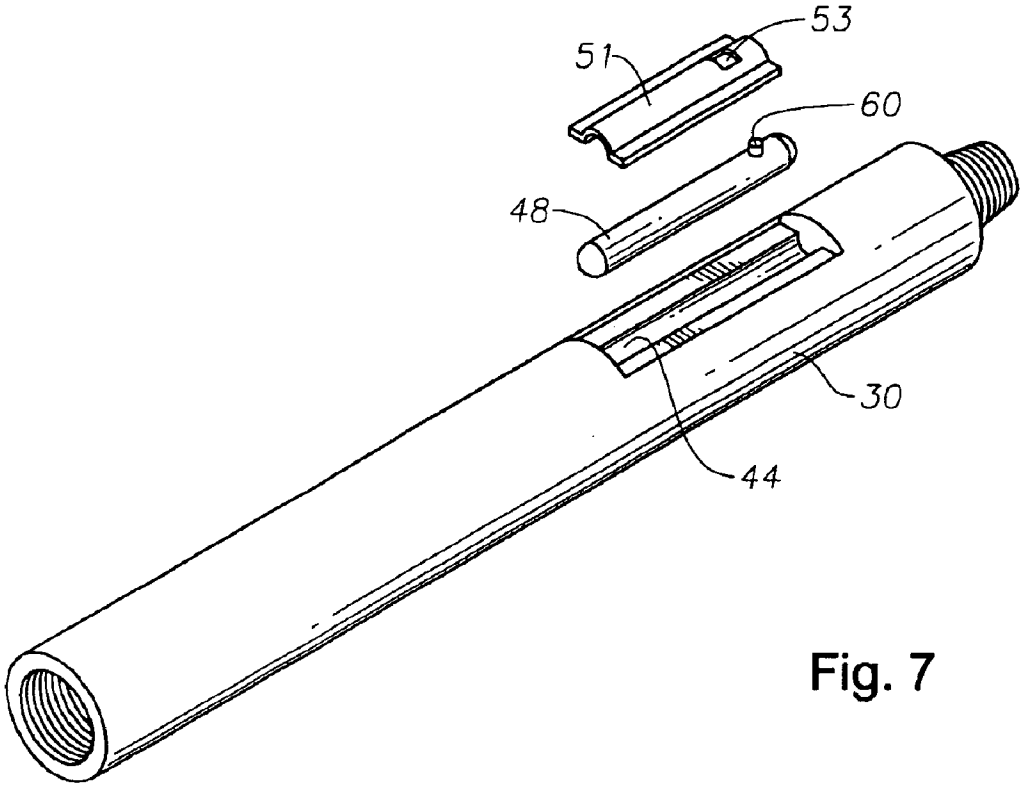
FIG. 7 is an isometric, exploded view illustrating use of a hatch cover with a drill collar and sensor module.

A pair of sensor module cavities 42, 44 are defined within the drill collar housing 30. One module cavity 42 is located upon the outer radial surface of the drill collar assembly 26, while the other module cavity 44 is located on the outer radial surface of a stabilizer blade 39. Both module cavities 42, 44 are open to the radial exterior of the drill collar assembly 26, essentially providing recesses therewithin. While two cavities 42, 44 are shown in FIGS. 2–5, it should be understood that there might be more or fewer, depending upon the needs of the user and the desired number of sensor modules. It is also noted that, although the cavities 42, 44 are shown disposed upon one side of the drill collar housing 30, in practice these cavities might be spaced from one another angularly about the circumference of the drill collar housing 30. For example, it might be desirable to house a module in each of the three stabilizer blades 39 to ensure that the modules are positioned in close proximity to the wall of the borehole 10 during use. Sensor modules 46, 48 are releasably secured within the cavities 42, 44, respectively. Clamps 50 are disposed over the modules 46 or 48, as illustrated, and screws 52 are used to secure the clamps against the body 30. As an alternative to the clamps 50, a unitary hatch cover might be used to enclose the modules 46, 48 within the cavities 42, 44. FIG. 7 illustrates use of an exemplary hatch cover 51 to secure a module 48 within cavity 44. The hatch cover 51 is secured to the body 30 using suitable connectors, in the same manner as the clamps 50 described previously, but may be more desirable when, for example, the wellbore 10 contains extremely corrosive fluids and it is desired to protect the modules from such fluid. The hatch cover 51 includes a window 53 that allows formation signals to more easily be transmitted to the module 48 through the hatch 51. The window 53 may comprise an opening in the hatch cover 51, but more preferably is a solid material that permits passage of energy and signals. An example is a beryllium metal window that allows low energy gamma rays to pass through and reach the module 48. The window 53 is located upon the hatch cover 51 so that it will be aligned with the sensor 60 of the module 48 when affixed to the housing body 30.

The drill collar housing 30 further includes a data and power transmission line 54 (visible in FIG. 3) that provides electrical power to the sensor modules 46, 48. The transmission line 54 also provides a means for data that is obtained by the sensor modules 46, 48 to be transmitted to a processor and storage medium, which is contained within a neighboring sub. A suitable current data and power transmission line for this application is that which is ordinarily referred to in the industry as the "M-30" arrangement, meaning "modem and 30 volts." Additionally, a power and data transmission cable 56 (see FIG. 3) is disposed within the body 30 to permit transmission of power and data between the two cavities 42 and 44. Electrical plug receptacles, schematically indicated at 58 are located on the upper portion of each sensor module cavity 42 and 44.

Figure 3:
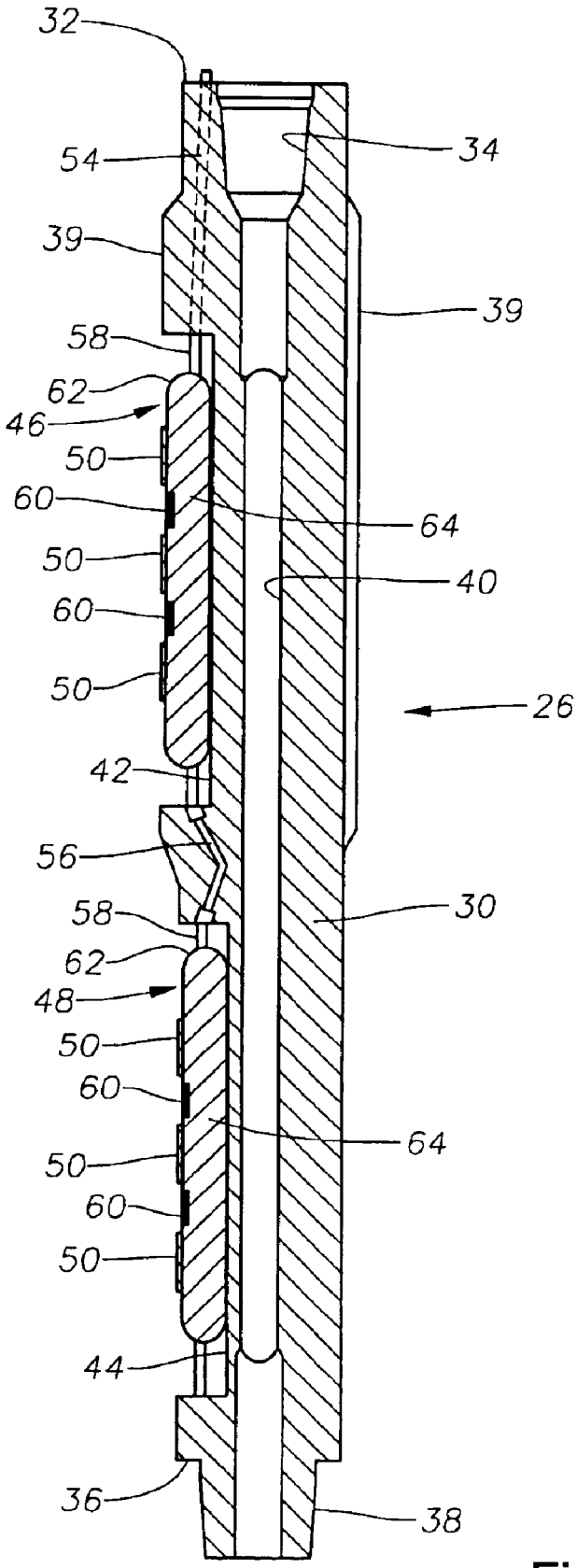
FIG. 3 is a side, cross-sectional view of the exemplary drill collar assembly taken along lines 3—3 in FIG. 2.

The sensor modules 46, 48 each include a plurality of sensors, schematically indicated at 60 in FIG. 3. The modules 46, 48 also include an electrical plug member 62 that is complimentary to the electrical plug receptacle 58 within the respective cavity 42 or 44. While the sensors 60 are shown in FIG. 3 to be a point source, in fact, the sensors 60 may be of any configuration and may actually cover a large portion of the surface area of the sensor module 46 or 48. The sensors 60 of each module 46, 48 are of a type known in the art for sensing a variety of wellbore or logging conditions (hereinafter, merely referred to as "wellbore conditions"), such as, principally, resistivity or porosity. Other wellbore conditions might also be detected in addition to or instead of these parameters, including velocity, imaging, photoelectric effect, acoustics, temperature, pressure, gamma radiation, position, and density. The modules 46, 48 each feature a housing, or sensor body, 64 that is shaped and sized to fit within one of the cavities 42, 44 of the drill collar housing 30 in a complimentary fashion. In the exemplary embodiment depicted in FIGS. 2–5, the sensor body 64 is cylindrical. However, other shapes and configurations may be used as well.

As best illustrated by FIG. 4, the outer diameter of the drill collar assembly 26 is not affected by insertion of the modules 46, 48, thereby not restricting the ability of the drill collar assembly 26 to be inserted into a borehole. FIG. 4A illustrates that the module 48 will reside within a stabilizer blade 39 of the drill collar housing body 30. This placement is desirable where the sensor must be positioned very close to the wall of the wellbore 10 during use in order to properly collect data. The use of standardized sizes and plugs for the sensor modules 46, 48 greatly improves the logistics associated with MWD and LWD tools.

Figure 6:
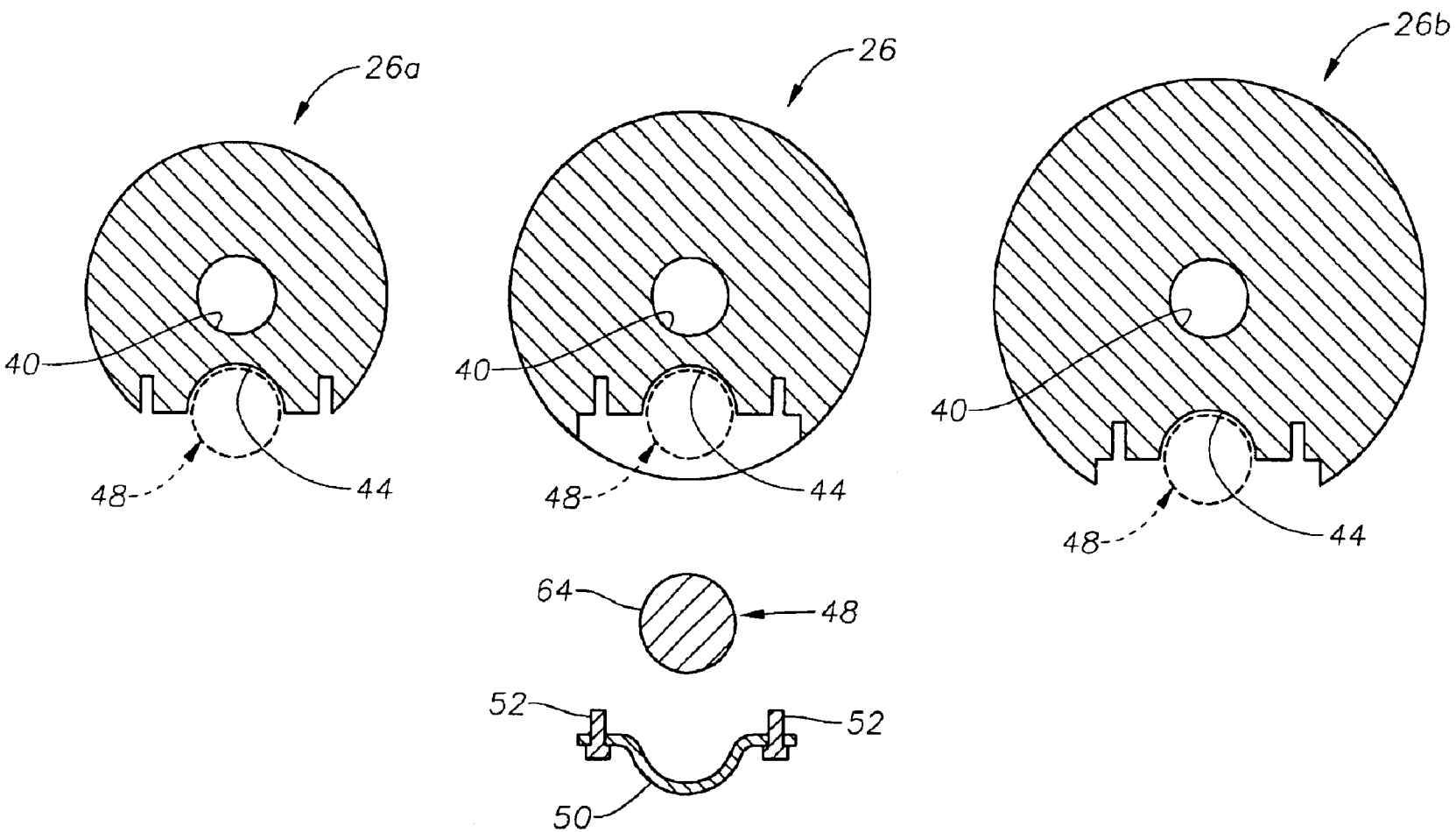
FIG. 6 illustrates the potential alternative placement of a sensor module into drill collar housings of different sizes.

Standardized modules are usable with drill collar housings of all hole sizes. For example, the modules 46, 48 might be removed from the first drill collar housing 26, which for purposes of example, is a 9½" diameter drill collar housing and then placed into a second larger drill collar housing **26*b* (a 12¼" housing) or, alternatively, a smaller drill collar housing 26*a* (an 8½" housing), as illustrated in FIG. 6. In this case, the size of the receptacle 44 remains the same among the various drill collar sizes despite the fact that the diameter of the drill collars does change. In addition, each of the various sizes of drill collars, 26, 26*a*, and 26*b*, preferably accommodates a common size of clamp 50 and connector 52** without requiring changes in the spacing or sizes of these components.

In operation, the sensor modules 46, 48 are inserted into the cavities 42, 44 of a properly sized drill collar 26, **26*a*, or 26*b*. That drill collar is then integrated into the drill string 18. The drill string 18 is disposed into the wellbore 10 until the drill collar assembly 26, 26*a*, or 26*b* is located proximate a desired zone of interest within the wellbore, which may be the bottom of the hole 10. Electrical power is transmitted via the data and power transmission line 54 to the sensor modules 46, 48, which then detect one or more wellbore conditions, depending upon the particular type of sensors that are incorporated into them. Data representative of the sensed wellbore conditions is then transmitted from the modules 46, 48 via the data and power transmission line 54** to a neighboring sub, which transmits the data uphole, in a manner known in the art.

Figure 8:
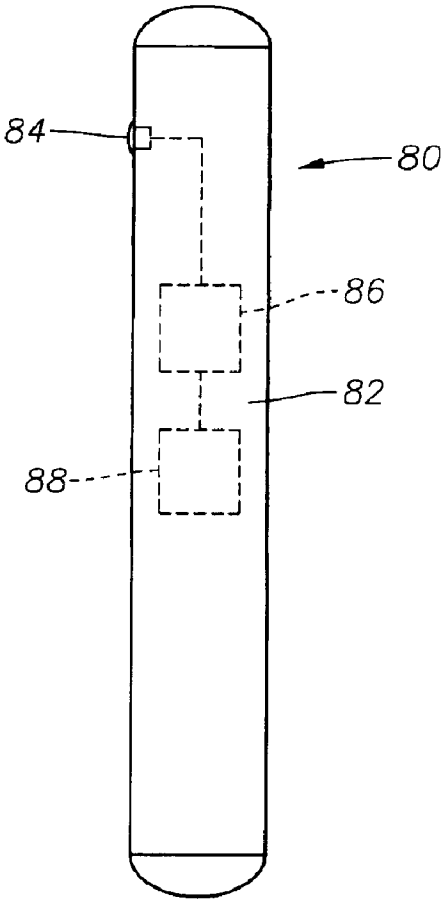
FIG. 8 is a schematic depiction of a sensor module having an internal power supply and data storage and processing means.

In an alternative embodiment, the sensor modules 44, 48 are self contained so that they do not require an external power source or communication of data to portions of the drill collar housing. FIG. 8 schematically depicts an exemplary self-contained sensor module 80 of this type. The module 80 includes a body 82 that carries a sensor 84 upon the outside surface. The sensor 84 is operably interconnected with a data storage and processing means 86, of a type known in the art. An internal power source 88, such as a battery, provides power to the data storage and processing means 86. When a self-contained module, such as module 80 is used, there is no need for an electrical plug member 62 to be included on the module or for the electrical plug receptacle 58 or for a data and power transmission line 54 or a power and data transmission cable 56 to be included in the body 30 of the drill collar housing. In this instance, the drill collar housing is merely "dumb" iron and serves only as a carrier for the module 80. In operation, the module 80 senses wellbore information with the sensor 84 and transmits the sensed data to the internal data storage and processing means 86 where the data resides until after the drilling operation is completed and the drill string removed from the wellbore 10. The module 80 may then be removed from the drill collar housing and the information retrieved from the data storage and processing means 84.

Other variations of the above-described constructions are possible utilizing the modular concepts described herein. For example, the drill collar housing 26 might, itself, have incorporated therein a bus wire, mud turbine power generator and mud telemetry pulser for transmitting sensed data to the surface. Additionally, the drill collar housings might be formed with or without stabilizer blades, such as blades 39 described previously.

The present invention improves log quality since there is no need to adapt a tool that is principally designed to operate in a different size hole for an orphaned hole size. The invention also improves utilization of the capital cost of a tool. Sensor components may be easily changed out or repaired without the necessity and cost of shipping the drill collar off-site for repair work.

Those of skill in the art will recognize that numerous modifications and changes may be made to the exemplary designs and embodiments described herein and that the invention is limited only by the claims that follow and any equivalents thereof.

What is claimed is:

1. A well logging tool comprising:

a housing for incorporation into a drill string and defining a cavity therein;

a sensor module having at least one sensor for detection of a wellbore condition, the sensor module being shaped and sized to removably reside within the cavity; and an electrical connection assembly having a complimentary plug member and receptacle to form an electrical connection between the sensor module and a power and data transmission line when the module is seated within the cavity.

2. The well logging tool of claim 1 wherein the sensor module is secured by a clamp that is affixed to the housing by a connector.

3. The well logging tool of claim 1 wherein the sensor module is secured by a hatch cover.

4. The well logging tool of claim 3 wherein the hatch cover includes a window to aid transmission of data through the hatch cover.

5. The well logging tool of claim 1 further comprising a data and power transmission conduit within the housing for transmitting electrical power and data between the cavity and the drill string.

6. The well logging tool of claim 1 wherein the sensor module includes at least one sensor for determining resistivity.

7. The well logging tool of claim 1 wherein the sensor module includes at least one sensor for determining porosity.

8. The well logging tool of claim 1 wherein there are multiple cavities within the housing and multiple sensor modules, each of the multiple modules being removably received within one of the multiple cavities.

9. The well logging tool of claim 8 further comprising a power and data transmission conduit for transmission of electrical power and data between the multiple cavities.

10. The well logging tool of claim 1 wherein the sensor module further includes an internal data storage and processing device.

11. The well logging tool of claim 1 wherein the sensor module further includes an internal power supply.

12. The well logging tool of claim 1 wherein the drill collar housing includes a radially extendable stabilizer blade, and the cavity is defined within the stabilizer blade.

13. A system for providing a sensor for detection of a wellbore condition within a variety of drill collar sizes, the system comprising:

a sensor module comprising a module housing and at least one sensor integrated into the housing for detection of a wellbore condition;

a first drill collar housing having a first diameter and a cavity therein that is complimentary in size and shape for receiving the sensor module therein; and a second drill collar housing having a second diameter that is different from the first diameter, the second drill collar also having a cavity therein that is complimentary in size and shape for receiving the same sensor module therein.

14. The system of claim 13 wherein the sensor is adapted to detect resistivity of a surrounding formation.

15. The system of the claim 13 wherein the sensor is adapted to detect porosity of a surrounding formation.

16. The system of claim 14 wherein the sensor module has a generally cylindrical shape.

17. The system of claim 14 wherein the sensor module has a first electrical connector and the housing has a second electrical connector that is complimentary to the first electrical connector.

18. The system of claim 14 wherein the module housing of the sensor module contains an internal data storage and processing means.

19. The system of claim 14 wherein the module housing of the sensor module contains an internal power supply.

20. A method for sensing a wellbore condition comprising:

providing a drill collar having a housing with a cavity for removably inserting a sensor module therein into a drill string, the cavity being located upon an outer radial surface of the housing;

placing a sensor module for sensing at least one wellbore condition into said cavity;

forming an electrical connection between the sensor module and a power and data transmission line within the housing when the sensor module is placed in the cavity;

disposing said drill string and drill collar into a wellbore; and sensing a wellbore condition with said sensor.

21. The method of claim 20 further comprising securing the sensor module within the cavity by disposing a clamp upon the sensor module and affixing the clamp to the housing.

* * * * *